United States Patent [19]

Karliner

[11] 4,416,588

[45] Nov. 22, 1983

[54] AIR COMPRESSOR FOR PAINT PUMPS

[75] Inventor: Rudolf Karliner, Minnetonka, Minn.

[73] Assignee: Wagner Spray Tech Corporation, Minneapolis, Mich.

[21] Appl. No.: 169,955

[22] Filed: Jul. 18, 1980

[51] Int. Cl.[3] ..... F04B 41/06

[52] U.S. Cl. ..... 417/199 R; 417/214; 417/319; 417/429; 92/13.3

[58] Field of Search ..... 417/429, 199 R, 214, 417/319, 521; 92/13.2, 13.3; 239/112, 113, 332

[56] References Cited

U.S. PATENT DOCUMENTS

| | | | |
|---|---|---|---|
| Re. 29,055 | 11/1976 | Wagner . | |
| 2,142,329 | 1/1939 | Nika, Jr. et al. | 417/199 R |
| 2,322,181 | 6/1943 | Vincent | 417/429 X |
| 2,413,851 | 1/1947 | Taylor | 417/199 R |
| 2,612,839 | 10/1952 | Denny | 417/429 |
| 2,925,780 | 2/1960 | Tear | 417/429 X |
| 3,254,845 | 6/1966 | Schlosser . | |
| 3,286,933 | 11/1966 | Savage | 239/332 X |
| 3,335,671 | 8/1967 | Schoenecker | 239/332 X |
| 3,430,557 | 3/1969 | Wagner . | |
| 3,623,661 | 11/1971 | Wagner . | |
| 4,022,381 | 5/1977 | Karliner . | |
| 4,167,896 | 9/1979 | Clements | 92/13.2 |

FOREIGN PATENT DOCUMENTS

| | | | |
|---|---|---|---|
| 488899 | 1/1954 | Italy | 417/199 R |
| 427910 | 5/1935 | United Kingdom | 417/429 |

*Primary Examiner*—Leonard E. Smith

*Attorney, Agent, or Firm*—Hill, Van Santen, Steadman, Chiara & Simpson

[57] ABSTRACT

A combination airless paint pump and air compressor wherein a prime mover drives an eccentric cam wheel within an oil reservoir housing. A piston, movably received within a housing bore is engageable with a periphery of the cam wheel to load an hydraulic column open to the piston cylinder for oscillating a paint spray pump diaphragm. A second piston member, received in a bore open to the housing, is engageable with the periphery of the cam wheel spaced circumferentially of the paint pump piston. The second piston is operatively connected with an air pump diaphragm. Selector means are provided to disengage, selectively, either one of the pistons from contact with the cam wheel whereby the unit can operate in a paint only mode, an air only mode or a combination air and paint mode.

12 Claims, 8 Drawing Figures

FIG. 4
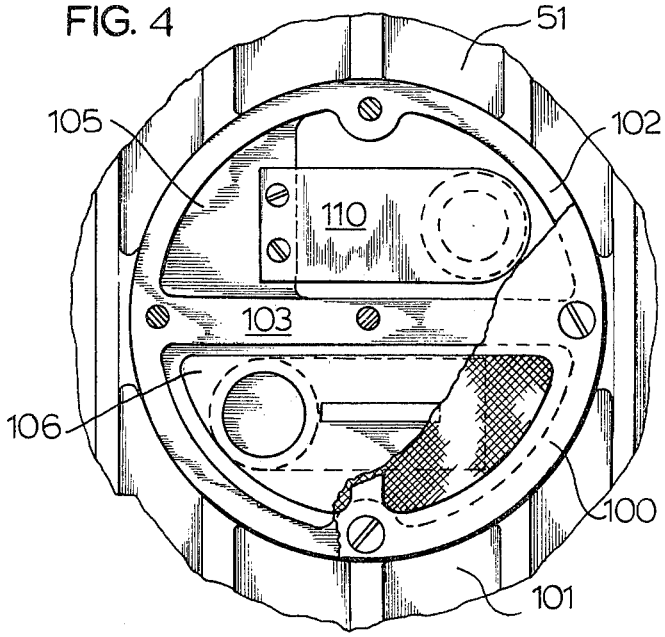
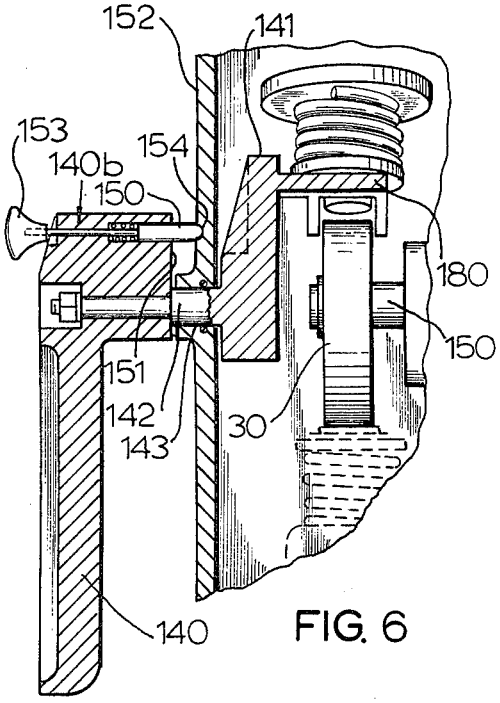
FIG. 6
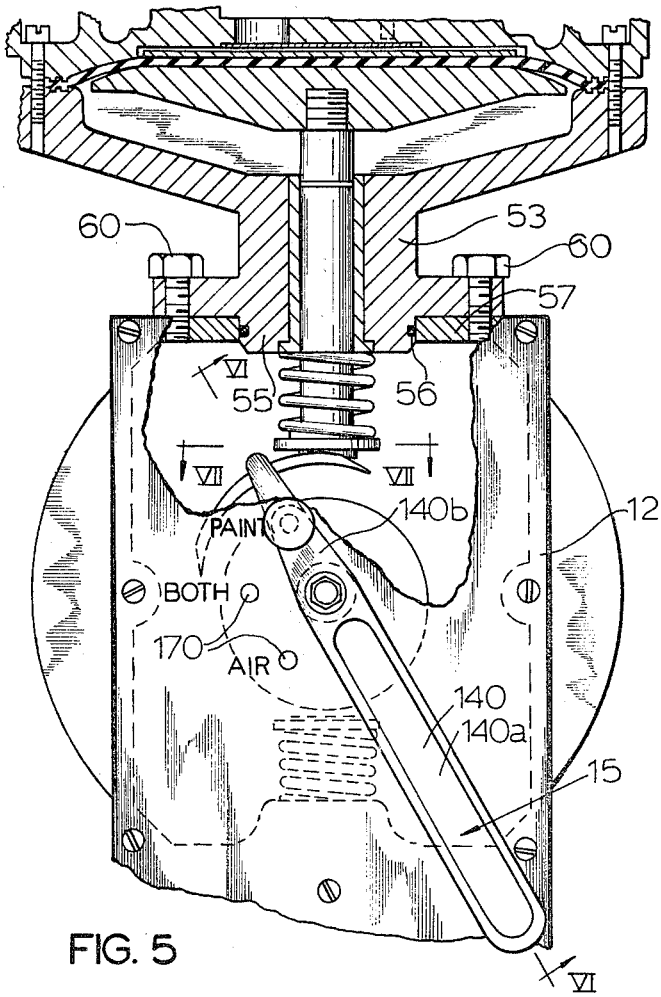
FIG. 5
FIG. 7
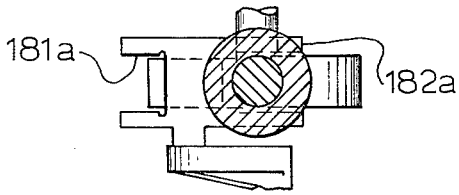

AIR COMPRESSOR FOR PAINT PUMPS

BACKGROUND OF THE INVENTION

1. Field of the Invention

This invention relates to pumps and more particularly to a combination paint and air pump.

2. Prior Art

Modern paint spraying equipment can be generally divided into two categories, air and airless. In air paint spraying, an air pump is used to provide a source of pressurized air which is intermixed with the paint by various means, including aspiration, to provide an atomized paint and air spray. In airless painting, the pump operates directly on the paint to force it at high pressure through a nozzle orifice where the paint is atomized providing a paint only spray.

Recently, it has been found desirable in many instances to surround the cone or fan of the spray pattern with an air or other gas stream. This type of spraying includes numerous variations, including some where an airstream is directed at the paint stream, particularly in association with airless paint spraying, and others where an airstream is formed as a shield radially exterior of the paint stream. In some forms of liquid spraying, it has been known to use an inert gas for the shield, however in most present embodiments, the shield or admixed gas is air. The obtaining of a separate air supply is relatively uncomplex when air spray painting is used since the air compressor can be used to supply both air for creation of the paint stream and air for creation of the secondary gas stream. However, in airless spray painting, no such gas supply is presently available and therefore such systems require the provision of separate air sources such as, for example, separate air compressors or factory line compressed air. It would therefore be an advantage to provide a single device which is capable of supplying both liquid at high pressure for airless spraying and pressurized air for the separate airstream.

Presently used airless paint spray equipment is most prominently of the diaphragm pump type where a prime mover reciprocates a piston to load and unload an hydraulic column in a driving fluid chamber. The driving fluid chamber is separated from the paint or driven fluid chamber by means of a diaphragm. Loading and unloading of the hydraulic column causes reciprocation of the diaphragm. Through appropriate valving, liquid to be sprayed is first drawn into and then expelled under pressure from the driven fluid chamber. Devices of this type are shown in U.S. Pat. Nos. 3,254,845 and 3,367,270 to Schlosser.

The drive to the piston may take many forms from use of an oscillating crank to the use of a wobble plate as shown in U.S. Pat. No. Re. 29,055 to Wagner, to the use of an eccentric cam wheel drive such as shown in U.S. Pat. Nos. 3,430,557 and 3,623,661 to Wagner, or other oscillating type connections. Common to all drive connections is the imparting of a reciprocating movement to the hydraulic column drive piston. Normally the drive connection is contained within a housing which forms an oil reservoir for the driving fluid with the cylinder in which the piston reciprocates being provided in a bore through an outside wall of the housing. Such a construction is shown in my prior U.S. Pat. No. 4,022,381 which utilizes an eccentric cam wheel drive.

When such prior art airless paint spray equipment is presently used with a painting system requiring the use of an additional gas source, such as for air surround painting, it is necessary to provide a separate compressed air supply. Since such prior airless paint spray equipment has a distinct advantage of ease of mobility, airless paint spraying has found wide-spread use in locations where compressed air is not readily obtained. Thus, to use spraying techniques calling for both airless spray painting and air supply, it has heretofor been necessary to bring to the painting site additional equipment for supplying the compressed air. This can lead to difficulties where the high pressure paint is utilized at a remote spray gun which also utilizes the air. In such situations two separate pressure lines must be provided to the remote gun. To the extent that these two pressure lines originate at different mechanisms, i.e. the paint pump and the air compressor, line entanglement, difficulty in ease of repositioning of the equipment and other disadvantages will occur. It would therefore be an advance in the art to provide a single pumping device which provides separate pressurized liquid and gas streams from a common drive. It would be a further advance in the art if such equipment could be used either for the simultaneous supply of liquid and gas or for the individual supply of liquid or gas.

SUMMARY OF THE INVENTION

The above improvements, and others, are provided by this invention which, in its most simple form, utilizes the power transmitting member of an airless paint spray pump to provide reciprocal movement to both the hydraulic column driving fluid piston and an air compressor piston with both the liquid pumping device and the gas pumping device being affixed to, carried by and formed as portions of a common housing. Selector means are provided to allow independent operation of either the liquid pumping means or the gas pumping means, or simultaneous operation of both the liquid and gas pumping means.

By attaching both the gas compressor and the liquid compressor to a common housing, and by using a single prime mover and power transmitter, substantially all of the disadvantages associated with separate equipment are eliminated. Moreover, a single piece of equipment having multiple purpose capabilities is provided at a fraction of the cost of the heretofore required separate equipment.

Surprisingly, I have found that the addition of a gas compressor to existing airless paint spray pumps can be accomplished without detracting from the capabilities of the paint spray equipment, without major modification to the paint spray equipment, and at a relatively economical cost.

In the preferred embodiment illustrated, I show an airless paint spray pump of the type driven by an eccentric bearing cam wheel with the cam wheel received interior of the driving fluid reservoir housing. Other types of power transmitting members can be utilized, such as the aforementioned linkages, swash plates, etcetera. The paint pump piston reciprocates in a cylinder journaled through one side wall of the housing. Diametrically opposite the paint pump piston, in an opposite side wall of the housing, I have journaled an air pump piston. Interposed between the ends of the pistons within the reservoir housing, is the eccentric bearing cam wheel affixed to the prime mover. In this manner, the two pistons operate opposite one another always moving in the same travel direction. The gas compressor piston has its end opposite the power transmitting member affixed to a diaphragm received in a gas compressor housing. Inlet and outlet valve controlled ports open to the diaphragm chamber on one side of the diaphragm such that on one stroke of the air compressor or liquid pumping piston, atmospheric air will be sucked into the diaphragm chamber and on the reverse stroke, the air will be expelled therefrom under pressure.

A disengagement means is provided through a front wall of the housing and includes an externally actuatable lever with a detent mechanism establishing three fixable positions. Internally of the housing, the lever actuates a lifter mechanism spaced radially from the periphery of the eccentric bearing drive. Movement of the external lever will cause the lifter mechanism to engage one or the other of the piston means to counteract the piston spring which otherwise urges the piston end face into contact with the cam wheel. In this manner, contact between one or the other of the pistons and the power transmitting member can be broken to disengage either the paint pump side or the gas pump side. In the third position of the lever, both pistons will contact the cam wheel drive to the end that both pumping means will be simultaneously operative.

It is the primary object therefore of this invention to provide a combination liquid and gas pumping means capable of supplying either pumped liquid, or pumped gas, individually or simultaneously, separately supplying pumped liquid and pumped gas.

It is a more specific object of this invention to provide an airless paint spray diaphragm pump having a gas compressor driven by a common power transmitting member from a common power source.

It is yet another, and general object of this invention to provide a single power device having capability of supplying a spray gun simultaneously with both liquid to be sprayed under high pressure and air or other gas to be sprayed with the liquid, the liquid and gas being separately supplied to the spray gun from a commonly driven pumping mechanism.

It is yet another specific object of this invention to provide a driven pumping mechanism having separate pumping chambers for gas and liquid powered by a common prime mover with means to selectively actuate either one of the pumping chambers or simultaneously actuate both of the pumping chambers.

It is yet another, and specific object of this invention to provide a pumping mechanism having a reservoir housing for a hydraulic column diaphragm paint pump with a power transmitting member operating interiorly of the housing in the driving fluid, first and second pistons projecting from peripheral walls of the housing engaging the power transmitting member for reciprocation thereby, the first piston driving a hydraulic column to power a diaphragm paint pump, the second piston driving a diaphragm air compressor.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 4 is an enlarged top plan view of the compressor housing with portions thereof broken away to show underlying portions.

FIG. 5 is an enlarged partially sectional view taken along the lines v—v of FIG. 2.

FIG. 6 is an enlarged sectional view taken along the lines vi—vi of FIG. 5.

FIG. 7 is a sectional view taken along the lines vii—vii of FIG. 5.

DESCRIPTION OF THE PREFERRED EMBODIMENTS

Figures 1, 8:
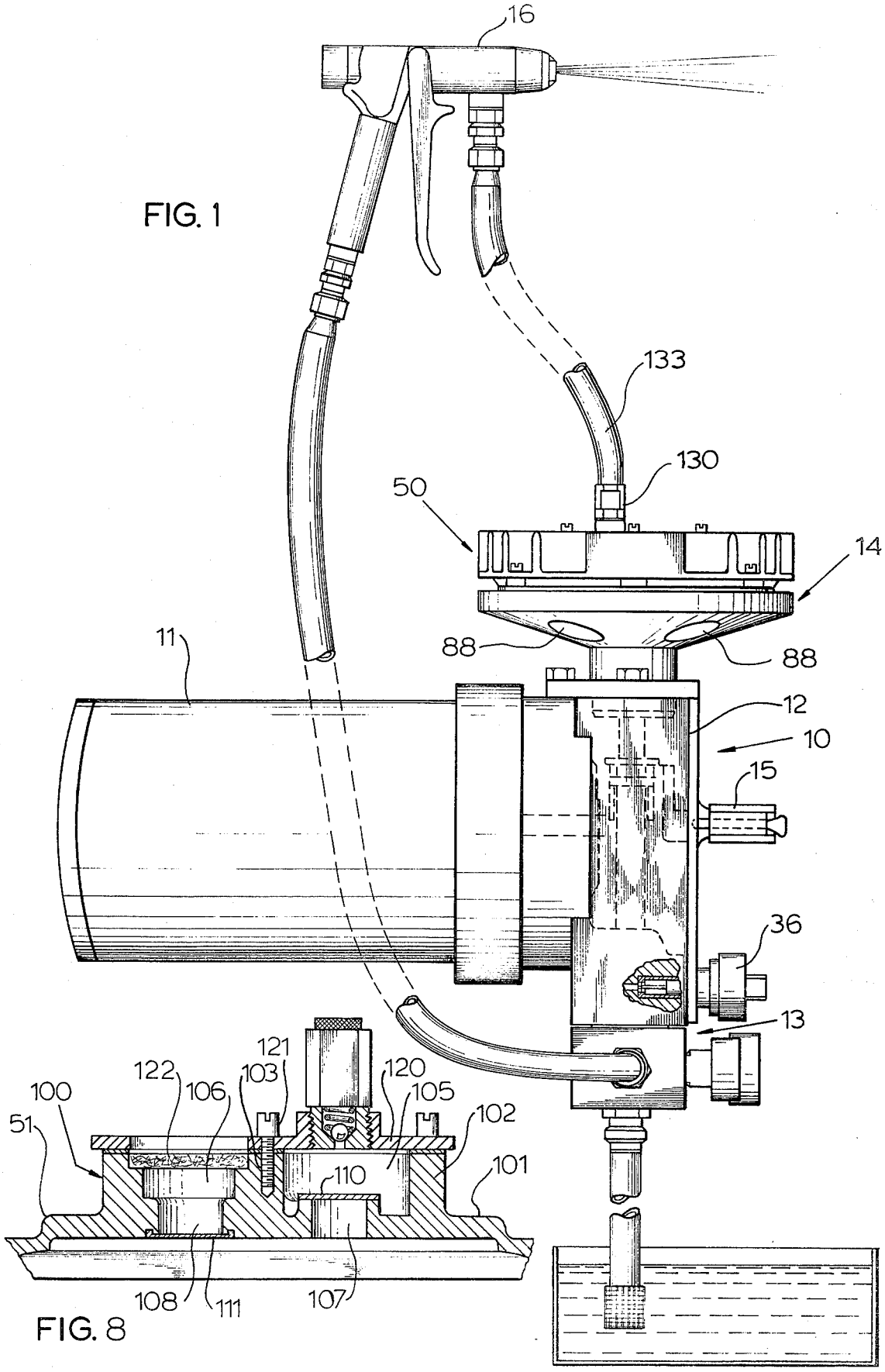
FIG. 1 is a side elevational view, with underlying parts shown by broken lines, of an airless paint spray pump and air compressor according to this invention.
FIG. 8 is a sectional view taken along the lines viii—viii of FIG. 2.

FIG. 1 illustrates, in side elevational view, with underlying portions illustrated by broken lines, a preferred embodiment of this invention. The device comprises a single unit combination airless paint spray diaphragm pump and air compressor 10 which includes a prime mover 11 such as an electric, gas or deisel motor, a reservoir housing 12, an airless diaphragm paint pump unit 13, a diaphragm air compressor unit 14, a selectable disengagement means 15, and a spray gun 16.

Figure 3:
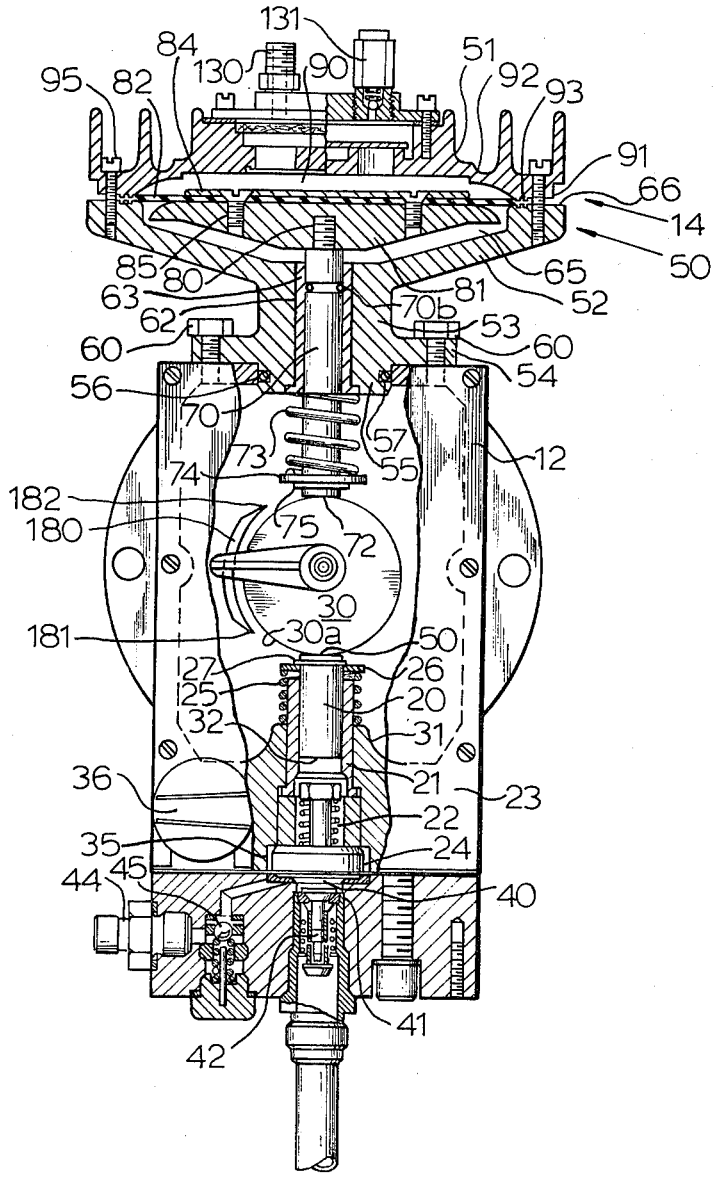
FIG. 3 is a front plan view, with portions in section, and other portions broken away of the device of FIG. 1.

As best illustrated in FIG. 3, the airless paint pump device includes a piston 20 received in a cylinder 21 journaled in a bottom side wall 22 of the housing 12. The piston cylinder is open to a pumping fluid chamber 23 on one side of a diaphragm 24. Spring means 25 act against a retainer 26 held on the piston 20 by means of snap ring 27 to urge the piston 20 against the power transmitting member 30. The power transmitting member of the preferred embodiment illustrated is of the eccentric bearing cam wheel type. As is known to those skilled in the art, a driving fluid inlet 31 communicates the cylinder 21 ahead of the front face 32 of the piston to the reservoir at the full upstroke of the piston 20. An outlet 35 communicates the driving fluid chamber through a pressure release valve 36 to the reservoir. Thus, a hydraulic column is maintained between the face 32 of piston 20 and the diaphragm 24. On the other side of the diaphragm 24, a paint chamber 40 is provided having an intake port 41 closed by check valve 42 open thereto and an outlet port 44 controlled by check valve 45 therefrom. Thus, the paint spray diaphragm pump operates as follows: on the downstroke or pressure stroke of piston 32, the hydraulic column forces diaphragm 24 into the paint chamber expelling any paint therein past check valve 45 to outlet port 44. On the succeeding upstroke of the piston 20 under influence of the spring 25, an under pressure condition will be created within the driving fluid chamber thereby lifting the diaphragm 24. This will suck paint or other liquid to be sprayed through check valve 42 into the pumped fluid chamber 41.

Pressure release valve 36 and the intake port 31 cooperate to maintain the hydraulic column and to provide for standby state self-regulation of the pump when the spray gun 16 is closed and the motor 11 remains running. For a more detailed explanation of the theory and operation of self-regulating diaphragm paint spray pumps, reference is made to the aforementioned U.S. patents, the teachings of which are specifically incorporated herein by reference.

It will be appreciated that due to the eccentric nature of the eccentric bearing cam wheel 30, as long as the prime mover 11 is causing rotation of the member 30, the piston 20 will be reciprocated absent some mechanism to disengage the piston end 50 from the periphery 30*a* of the cam wheel.

Figure 2:
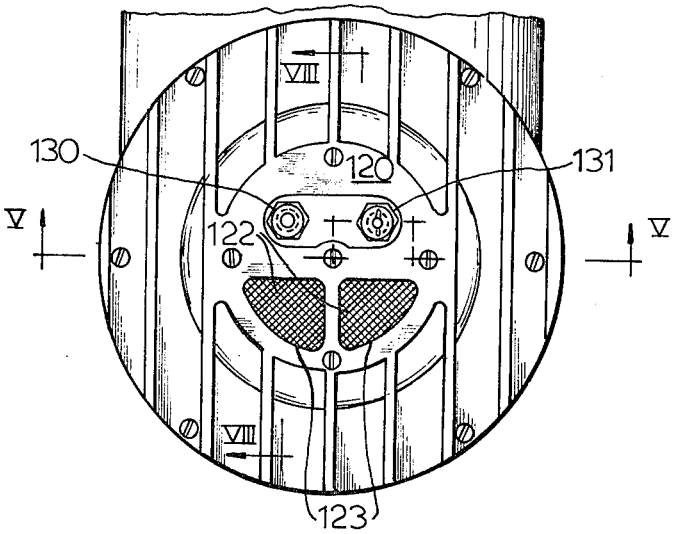
FIG. 2 is a top plan view of the air compressor housing.

The air compressor 14 includes a housing 50 having upper 51 and lower 52 housing halves. The lower housing half has a centrally extending pedestal 53 which, at its bottom regions, as shown in FIG. 2, has out-turned flange structure 54 and a central boss 55 dimensioned to be received in a bore 56 in the top wall 57 of the housing 12. Seal means such as O-ring seals 57 received in a groove in the boss 55 provide a liquid tight seal between the boss 55 and the wall of the bore 56. Flange 45 has bores receiving a series of bolts 60 for securing the lower housing half 52 to the top wall of the housing 12. A central bore 62 extends upwardly through the pedestal and receives a cylinder liner or tubular bushing 63. The open ends of the cylinder liner 62 are open respectively to the interior of the reservoir housing 12 and to a central depression 65 formed in the top face 66 of the lower housing half 52.

A piston 70 projects through the cylinder liner 63 into both the dished area 65 and the interior of housing 12. Within housing 12, the piston 70 terminates in an inface 72 which is urged into engagement with the periphery 30*a* of the cam wheel 30 by spring means 73 acting between the end of the boss 55 or an out-turned flange of the cylinder liner, as shown in FIG. 3, and a retainer 74 maintained on the piston by snap ring 75. The upper end 80 of piston 70 is in threaded connection with a backing disc 81 to which a diaphragm 82 is secured. As illustrated in FIG. 3, the diaphragm 80 may be secured to the backing disc by entrapment of the diaphragm between a holding plate 84 and the backing disc 81, the plate 84 being held in position by screws 85 threaded into appropriate openings in the backing disc. The backing disc is relatively massive in comparison to the plate 84 and can function as a heat sink drawing heat from the diaphragm and from the plate 84 and therefore from the diaphragm chamber 90. Opening 88 may extend through the lower housing half 52 to the dished area 65 to aid in heat dissipation while at the same time opening the chamber below the diaphragm 82 to the exterior atmosphere.

The upper housing half 51 has a bottom face 91 having a central dished section 92 defining the diaphragm chamber 90 above the diaphragm 2. The diaphragm has its outer periphery trapped between the opposed planer surfaces formed at the outer periphery of the top face 66 of the bottom housing half 52 and the bottom face 91 of the top housing half 51. Mating teeth and grooves 93 in the opposed faces can lock the diaphragm periphery in position and bolt means 95 can be utilized to secure the top housing half 51 to the bottom housing half 52.

As best shown in FIGS. 4 and 8, the top housing half 51 is formed with a central area 100 of the top face 101. The central area 100 has a boundary wall 102 and a divider wall 103 which define recessed areas 105 and 106 separated from one another by wall 103. Ports 107 and 108 communicate areas 105 and 106 respectively to the diaphragm chamber 90. Flapper valves 110 and 111 respectively close ports 107 and 108 with flapper valve 120 being mounted within chamber 105 and flapper valve 111 being mounted within diaphragm chamber 90.

Valves 110 and 111 operate such that gas can pass from area 106 to chamber 90 but not in reverse flow, whereas air can pass from chamber 90 through port 107 past valve 110 to chamber 105 but not in reverse. Thus, valve 111 acts an inlet valve to diaphragm chamber 90 and valve 110 operates as an outlet valve.

Chambers 105 and 106 are closed by a cap 120 affixed to the wall 100 by bolt means 121. Filter media 122 may be interposed between chamber 106 and the cap 120. Cap 120 is provided with one or more openings 123 to the chamber 106 so that air can flow through the openings 123, thence through the filter media 122 to the chamber 106 to be drawn into the diaphragm chamber 90 past flapper valve 111.

Cap 120, on the other hand, closes chamber 105 except for outlet port 130 and a pressure release valve 131. Outlet port 130 may include a threaded projection for attachment to an air hose 133 for supply of compressed air from the diaphragm chamber 90 to the spray gun 16. Pressure release valve 131 is preferably of the adjustable type, such as a spring pressed ball valve, as shown in FIG. 8, so as to allow the maximum pressure of the compressed gas to be safely controlled.

It is to be understood that in the embodiment illustrated, the upper and lower housing halves are circular but, however, this is a matter of design choice only. Moreover, the upper housing half as shown is provided with cooling veins on its top surface whereas the lower housing half is shown without such cooling veins. As desired, the veins may be provided on the lower housing half external surfaces also.

It should be additionally appreciated that although I have shown intake chamber 106 to be open to the atmosphere through the filter media 122 and the openings 123 of cap 120, if desired, the portion of cap 120 covering the chamber 106 can also be provided substantially solid with an intake port such as the outlet port 130. In this embodiment, if it is desired to utilize the gas pump 14, in association with specific gases, such as, for example, inert gas or conversely gases having predetermined reactions with the liquid being sprayed, it is only necessary to attach a gas source to the then provided intake port.

As can be clearly seen from FIG. 3, in the preferred embodiment, the piston 70 is diametrically opposed to the piston 20 such that each contacts an opposite side of the power transmitting member 30. In this construction, the two diaphragms will be moving between compression and suction states 180° out of phase and the pistons in associated mechanism will be moving in the same direction in the common plane. However, if desired, other driving systems can be utilized to change this, or, if desired, the air pump and the liquid pump can be mounted on the housing 12 other than diametrically opposed to one another.

Moreover, it should be apparent to those skilled in the art that other driving mechanisms may require different arrangements of the liquid and air pumps. For example, when using a swash plate drive, the ends 50 and 72 of the respective pistons 20 and 70 will be arranged to contact a common face of the swash plate.

As best illustrated in FIGS. 5, 6 and 7, a disengagement means 15 is provided for disengaging either the paint pumping means or the gas pumping means. The disengagement means 15 includes a lever 140 exterior of the housing 12 and a lifter mechanism 141 interior of the housing. The lever 140 and the lifter 141 are affixed to a common axis member 142 which extends through a boring 143 in the front cover substantially aligned with the drive shaft 150 from the prime mover 11 to the eccentric bearing cam wheel 30. The lever is formed as a handle member having a handle portion 140*a* to one side of the axis 142 and a projection 140*b* to the other side of the axis. The projection 140*b* has a spring loaded detent 150 projecting from an underside 151 thereof into engagement with a front face 152 of the housing 12. A pull knob 153 is provided on the outside of the projection 140*b* so as to allow the end of the detent to be drawn back against the spring to release contact between the detent bottom 154 and the front face. The front face 152 is provided with space dimple recesses 170 contoured to receive the end 154 to effectively lock the lever 140 in position.

Interior of the housing, the lifter includs a projection 180 which extends axially over the cam wheel 30 radially spaced from the periphery 30*a* thereof. The projection 180 is arcuately curved having spaced ends 181 and 182 which terminate in split fork sections 181*a* and 182*a*. The split fork sections are dimensioned such that the end portion of either the piston 20 or the piston 70, respectively, can be received between the tines of the split fork end with the tines engaging either the snap ring 27–75 or the lifter 26–74 respectively of the piston 20–70. The tines may be bevelled as shown in FIG. 3 as the arcuate shape of the projection 180 is preferably formed such that as the lever 140 is rotated, the tines will be brought into engagement with the identified portions of one of the pistons to cause that portion to be lifted radially away from the periphery of the cam wheel 30. This will effectively disengage the selected piston from drive contact with the eccentric bearing cam wheel thus disabling the associated one of the liquid pumping means or the gas pumping means.

The projection 180 has a circumferential length such that, in the embodiment illustrated, it can be brought to a position, upon rotation of the handle 140*a*, where neither of the tined ends is in engagement with one of the pistons. In that position, both pumping means will be in operative drive relationship with the power transmission member 30.

The dimples 170 are formed in the face 152 at spaced points to maintain the disengagement means either at a point of engagement with the liquid pumping means piston, or the paint pumping means piston, or out of engagement with both pistons.

It should be appreciated by those skilled in the art, that in the particular preferred embodiment illustrated, by maintaining both of the pistons within the driving fluid reservoir, that oil splash occuring within the reservoir will adequately lubricate both pistons. In order to limit flow of lubricant into the diaphragmed area of the air compressor or liquid pumping means, an O-ring or other seal 70*b* may be employed between the piston 70 and the cylinder liner 63. When using such a seal, if desired, the tines of the lifter can then engage the retainer 74, since on the next rotation of the eccentric drive, the piston 70 will be lifted upwardly and be held in that position by the friction of the engagement between the O-ring seal 70*b* and the cylinder liner wall. In such a construction, where the compressor portion is mounted vertically above the paint portion, the tines can also engage the retainer 26 thereby allowing the piston 20 to drop by gravity. In other angular positions to the horizontal, it is preferable if the tines contact a member fixed in position on the respective piston. This can either be the snap ring 75–27 or, could, if desired, be a lifter backed by a second snap ring.

In the preferred embodiment, I have constructed the diaphragm 82 of a nylon reinforced rubber and have dimensioned both the disc 81 and the holding plate 84 of relatively large diameters. I have found this reduces fatigue life on the diaphragm. In other embodiments, other dimensions and diaphragm materials may be preferred.

Further, although I have illustrated the device employing flapper valves, it is to be understood that other valves, such as ball valves may be used if desired.

It will therefore be appreciated from the above, that my invention provides a multi-purpose pumping device having both airless liquid pumping and gas pumping capabilities driven from a common drive, with either the liquid pumping means, or the gas pumping means being selectively engageable or both pumping means being simultaneously engageable. In the preferred embodiment illustrated, both the liquid pump and the gas pump are diaphragm pumps, the liquid pump being an hydraulic diaphragm airless paint spray pump and the gas pumping means being a dry diaphragm pump.

Although the teachings of my invention have herein been discussed with reference to specific theories and embodiments, it is to be understood that these are by way of illustration only and that others may wish to utilize my invention in different designs or applications.

I claim as my invention:

1. In an airless liquid coating spray pump having a reservoir housing with a pump drive power transmitting means received in the housing, a liquid coating pump piston extending through a wall of the housing having an end within the housing engaging the power transmitting means, and a liquid coating pumping chamber exterior of the housing operatively acted upon by reciprocation of the piston, the improvement of a bore through a wall of the housing, a second piston received in the bore having an end in the housing in engagement with the power transmitting means, a gas compressor exterior of the housing, and a second end of the second piston operatively associated with the gas compressor, each of the pistons being reciprocated by engagement with the power transmitting member, and the reciprocation of each piston being effective to operate the associated liquid coating pump and compressor to compress gas by the gas compressor and to pressurize liquid coating by the liquid coating pump, and means for disengaging one of the pistons from engagement with the power transmitting means, said means for disengaging effective to de-activate one of the liquid coating pump and compressor upon disengagement of one of the pistons from engagement with power transmitting means, said means being selectively actuatable to provide selected operation in each of three modes, a first of said modes simultaneously operating said liquid coating pump and said gas compressor, a second of said modes operating only said gas compressor, and a third of said modes operating only said liquid coating pump.

2. A combination paint pump and air compressor comprising a housing member having walls, first and second bores in said walls, first and second pistons respectively received in said bores, a paint pumping chamber exterior of said housing, an air compressor chamber exterior of said housing, said first piston operatively associated with the paint pumping chamber to load and unload paint within said chamber, the second piston operatively associated with the air compressor to compress air within said air compressor, separate outlets from said paint pump and said air compressor, a common drive means reciprocating said pistons, and means for selectively disengaging the drive connection to either of said pistons the means for selectively disengaging being selectively operable to disengage either one of said pistons effective to, upon disengagement, prevent operation of the associated air compressor or paint pump while allowing continued operation of the other of the compressor or paint pump, said means for selectively disengaging being postionable to allow continued drive connection to both of said pistons whereby both of said air compressor and paint pump are simultaneously operated by said drive means.

3. The device of claim 2 wherein the first bore is positioned in a housing wall opposite the housing wall containing the second bore, the first and second bores being aligned, the drive connection being an eccentric cam wheel positioned between the pistons, and spring means urging each of the pistons against a periphery of the eccentric cam wheel.

4. The device of claim 2 wherein the outlets from said paint pump in said air compressor are connected to inlets to separate conduits having outlets connected to a common spray gun whereby either paint alone, air alone, or both air and paint may be provided to the spray gun upon selective actuation of the means for selectively disengaging.

5. In an airless paint spray device having a prime mover driving a power transmitting means, the power transmitting means being in operative driving connection with a reciprocating piston driving a hydraulic column to reciprocate a diaphram exposed to the hydraulic column, the diaphram having a side opposite exposure to the hydraulic column open to a paint pump chamber, with movement of the diaphragm effective to suck paint into the paint pump chamber and expel paint from an outlet of the paint pump chamber under high pressure, the reciprocating piston being received in a bore of a housing, the housing defining a reservoir for hydraulic fluid for supplying said hydraulic column, the improvement of said housing having a second bore spaced from said bore, a second reciprocating piston received in said second bore, the power transmitting means being in operative driving connection with the second reciprocating piston, said second reciprocating piston being in mechanical driving relation with a second diaphragm, the second diaphragm being part of a dry diaphragm air compressor, the second diaphragm having a side opposite the connection to the separate second reciprocating piston open to an air compressor chamber and effective to draw air from an inlet to the air compressor chamber and to expel air under pressure through an oulet from the air compressor chamber upon reciprocation of the second diaphragm, selector means carried by the housing having at least three operative positions, a first of said positions providing simultaneous driving connection between the power transmitting means and to the first and second pistons for simultaneous operation of the airless paint pump and air compressor, a second of said positions disengaging driving connection between the power transmitting means and reciprocating piston effective to disable operation of the airless paint pump while maintaining operation of the air compressor and a third of said positions disengaging driving connection between the power transmitting means and second piston effective to disable operation of the air compressor while maintaining operation of the airless paint pump.

6. The paint spray device of claim 5 including a paint spray gun, a first coduit in communication with the outlet from the paint pump chamber and a first inlet to the paint spray gun and a second conduit in communication with the outlet from the air compressor chamber and in communication with a second inlet to the spray gun.

7. A combination paint pump and air compressor comprising a housing member having walls, first and second bores in said walls, first and second pistons respectively received in said bores, a paint pumping chamber exterior of said housing, an air compressor chamber exterior of said housing, said first piston operatively associated with the paint pumping chamber to load and unload paint within said chamber, the second piston operatively associated with the air compressor to compress air within said air compressor, separate outlets from said paint pump and said air compressor, a common drive means reciprocating said pistons, and means for selectively disengaging the drive connection to either of said pistons the means for selectively disengaging being selectively operable to disengage either one of said pistons effective to, upon disengagement, prevent operation of the associated air compressor or paint pump while allowing continued operation of the other of the compressor or paint pump, said means for selectively disengaging being positionable to allow continued drive connection of both of said pistons whereby both of said air compressor and paint pump are simultaneously operated by said drive means, the first bore is positioned in a housing wall opposite the housing wall containing the second bore, the first and second bores being aligned, the drive connection being an eccentric cam wheel positioned between the pistons, and spring means urging each of the pistons against a periphery of the eccentric cam wheel, the means for disengaging includes a lifter having a portion radially spaced from an outer diameter periphery of the cam wheel, the portion being movable from a position in engagement with a first of the pistons to a position in engagement with a second of the pistons, the lifter effective to lift the engaged piston from contact with the periphery of the cam wheel.

8. The device of claim 7 wherein the portion has a third position out of engagement with either of the pistons.

9. The device of claim 8 wherein the air compressor includes a housing defining a chamber therein, the chamber being divided by a diaphragm, the second piston being connected to the diaphragm.

10. The device of claim 9 wherein the air compressor includes inlet and outlet valve ports to a portion of the chamber opposite the projection of the piston from the housing into the chamber.

11. The device of claim 10 wherein the valve ports include flapper valves.

12. The device of claim 11 wherein releasable detent means are provided for locking the lifter in a selected one of said first, second and third positions.

* * * * *